US008061443B2

(12) United States Patent
Hall et al.

(10) Patent No.: US 8,061,443 B2
(45) Date of Patent: Nov. 22, 2011

(54) DOWNHOLE SAMPLE RATE SYSTEM

(75) Inventors: David R. Hall, Provo, UT (US); Paula Turner, Pleasant Grove, UT (US); Christopher Durrand, Pleasant Grove, UT (US)

(73) Assignee: Schlumberger Technology Corporation, Houston, TX (US)

( * ) Notice: Subject to any disclaimer, the term of this patent is extended or adjusted under 35 U.S.C. 154(b) by 317 days.

(21) Appl. No.: 12/109,211

(22) Filed: Apr. 24, 2008

(65) Prior Publication Data

US 2009/0266609 A1 Oct. 29, 2009

(51) Int. Cl.
*E21B 47/00* (2006.01)
*G01V 3/00* (2006.01)

(52) U.S. Cl. ..... 175/50; 324/338

(58) Field of Classification Search ..... 175/40, 175/50; 324/333, 338, 339, 345, 346
See application file for complete search history.

(56) References Cited

U.S. PATENT DOCUMENTS

| | | | | |
|---|---|---|---|---|
| 2,414,719 | A | | 1/1947 | Cloud |
| 3,967,201 | A | | 6/1976 | Rorden |
| 4,416,494 | A | | 11/1983 | Watkins |
| 4,785,247 | A | | 11/1988 | Meador |
| 4,806,928 | A | | 2/1989 | Vereruso |
| 4,919,201 | A | * | 4/1990 | Bridges et al. ..... 166/60 |
| 4,933,640 | A | * | 6/1990 | Kuckes ..... 324/339 |
| 5,045,795 | A | | 9/1991 | Gianzero et al. |
| 5,337,002 | A | | 8/1994 | Mercer |
| 5,606,260 | A | | 2/1997 | Giordano et al. |
| 6,100,696 | A | | 8/2000 | Sinclair |
| 6,163,155 | A | | 12/2000 | Bittar |
| 6,218,842 | B1 | | 4/2001 | Bittar et al. |
| 6,223,826 | B1 | | 5/2001 | Chau |
| 6,359,438 | B1 | | 3/2002 | Bittar |
| 6,367,564 | B1 | | 4/2002 | Mills |
| 6,392,317 | B1 | | 5/2002 | Hall |
| 6,446,728 | B2 | | 9/2002 | Chau |
| 6,476,609 | B1 | | 11/2002 | Bittar |
| 6,538,447 | B2 | | 3/2003 | Bittar |
| 6,577,129 | B1 | | 6/2003 | Thompson et al. |
| 6,641,434 | B2 | | 11/2003 | Boyle et al. |
| 6,651,755 | B1 | | 11/2003 | Kelpe |
| 6,655,464 | B2 | | 12/2003 | Chau |
| 6,670,880 | B1 | | 12/2003 | Hall |
| 6,677,756 | B2 | | 1/2004 | Fanini et al. |
| 6,688,396 | B2 | | 2/2004 | Floerke et al. |
| 6,717,501 | B2 | | 4/2004 | Hall |
| 6,739,413 | B2 | | 5/2004 | Sharp |
| 6,799,632 | B2 | | 10/2004 | Hall |
| 6,821,147 | B1 | | 11/2004 | Hall |
| 6,830,467 | B2 | | 12/2004 | Hall |
| 6,844,498 | B2 | | 1/2005 | Hall |
| 6,845,822 | B2 | | 1/2005 | Chau |

(Continued)

*Primary Examiner* — David Bagnell
*Assistant Examiner* — Catherine Loikith
(74) *Attorney, Agent, or Firm* — Brinks Hofer Gilson & Lione

(57) ABSTRACT

In one aspect of the invention, a downhole sensor system comprises at least one downhole sensor disposed on or within a downhole component of a tool string. The downhole sensor is adapted to detect at least one characteristic of a downhole formation adjacent the downhole component. The downhole sensor has a variable sampling rate controlled by a processing element. The processing element is in electrical communication with a tool string rate-of-penetration sensor and/or a tool string rotational speed sensor. The processing element is adapted to vary the sampling rate in response to the rate-of-penetration and/or rotational speed of the tool string. In some embodiments, the system is a closed loop system.

17 Claims, 13 Drawing Sheets

U.S. PATENT DOCUMENTS 6,871,713 B2 * 3/2005 Meister et al. ..... 175/50
6,888,473 B1 5/2005 Hall
6,913,093 B2 7/2005 Hall
6,929,493 B2 8/2005 Hall
6,945,802 B2 9/2005 Hall
6,968,611 B2 11/2005 Hall
7,028,779 B2 4/2006 Chau
7,139,218 B2 11/2006 Hall et al.
7,141,981 B2 11/2006 Folberth et al.
7,150,329 B2 12/2006 Chau
7,265,649 B1 9/2007 Hall et al.
7,301,429 B1 11/2007 Hall et al.
7,398,837 B2 7/2008 Hall et al.
7,583,085 B2 * 9/2009 Hall et al. ..... 324/338
7,588,083 B2 * 9/2009 Newman ..... 166/255.1
2004/0104797 A1 6/2004 Hall
2004/0113808 A1 6/2004 Hall
2004/0145492 A1 7/2004 Hall
2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall
2004/0244964 A1 12/2004 Hall
2004/0246142 A1 12/2004 Hall
2005/0001735 A1 1/2005 Hall
2005/0001736 A1 1/2005 Hall
2005/0001738 A1 1/2005 Hall
2005/0035874 A1 2/2005 Hall
2005/0035875 A1 2/2005 Hall
2005/0035876 A1 2/2005 Hall
2005/0036507 A1 2/2005 Hall
2005/0039912 A1 2/2005 Hall
2005/0045339 A1 3/2005 Hall
2005/0046586 A1 3/2005 Hall
2005/0046590 A1 3/2005 Hall
2005/0067159 A1 3/2005 Hall
2005/0070144 A1 3/2005 Hall
2005/0082092 A1 4/2005 Hall
2005/0092499 A1 5/2005 Hall
2005/0093296 A1 5/2005 Hall
2005/0095827 A1 5/2005 Hall
2005/0115717 A1 6/2005 Hall
2005/0145406 A1 7/2005 Hall
2005/0150653 A1 7/2005 Hall
2005/0161215 A1 7/2005 Hall
2005/0173128 A1 8/2005 Hall
2005/0194134 A1 * 9/2005 McGregor et al. ..... 166/264
2005/0194182 A1 * 9/2005 Rodney et al. ..... 175/24
2005/0199425 A1 * 9/2005 Estes et al. ..... 175/50
2005/0212530 A1 9/2005 Hall
2005/0236160 A1 10/2005 Hall
2005/0284662 A1 12/2005 Hall
2007/0272442 A1 * 11/2007 Pastusek et al. ..... 175/40
2008/0264624 A1 * 10/2008 Hall et al. ..... 166/66.5
2008/0265892 A1 10/2008 Snyder et al.

* cited by examiner

DOWNHOLE SAMPLE RATE SYSTEM

BACKGROUND OF THE INVENTION

For the past several decades, engineers have worked to develop apparatus and methods to effectively obtain information about downhole formations, especially during the process of drilling and following this process using wireline methods or pushed tool methods for use in horizontal wells. These methods may be collectively referred to as logging. During the drilling process and, with time afterward, drilling fluids begin to flush and intermingle with the natural fluids in the formation forming an invasion zone near the drilled borehole. This fluid exchange increases with time and the formation wall can degrade or become damaged with further drilling operations which can mask or alter information about the formation that is of interest. Logging-while-drilling (LWD) refers to a set of processes commonly used by the industry to obtain information about a formation during the drilling process. In some cases the acquired data from components located downhole on oil and gas drilling strings are transmitted to the ground's surface. Measurement-while-drilling (MWD) and LWD methods are also used in smart drilling systems to aid and/or direct the drilling operations and in some cases to maintain the drill in a specific zone of interest. The terms MWD and LWD are often used interchangeably in the industry and LWD will be used here to refer to both methods with the understanding that the LWD encompasses systems that collect formation, angular rotation rate and depth information and store this information for later retrieval and/or transmission of this information to the surface while drilling.

A common sensor used in logging systems is for the measurement of resistivity or the complement conductivity. The resistivity of the formation is quite often measured at different depths into the formation to determine the amount of fluid invasion and aid in the calculation of true formation resistivity. The formation resistivity is generally used with other sensors in an analysis to determine many other formation parameters. There are various types of resistivity sensors including direct current (DC), and alternating current (AC) focused resistivity which utilizes one or more electrodes devices, AC scanned resistivity which measures in a specific circumferential or angular pattern around the borehole and a fourth type called induction or propagation resistivity which also utilizes AC methods. Induction resistivity sensors generally use lower frequencies below 100 KHz while propagation sensors use higher frequencies. The terms induction sensor or induction tool will be used interchangeably here and will refer to both induction and propagation resistivity methods.

U.S. Pat. No. 6,677,756 to Fanini et al.; U.S. Pat. No. 6,359,438 to Bittar; U.S. Pat. No. 6,538,447 to Bittar; U.S. Pat. No. 6,218,842 to Bittar et al.; U.S. Pat. No. 6,163,155 to Bittar; U.S. Pat. No. 6,476,609 to Bittar; U.S. Pat. No. 6,577,129 to Thompson et al; U.S. Pat. No. 7,141,981 to Folberth et al; U.S. Pat. No. 5,045,795 to Gianzero, et al.; U.S. Pat. No. 5,606,260 to Giordano et al.; and U.S. Pat. No. 6,100,696 to Sinclair, each of which is herein incorporated by reference for all that it contains, disclose embodiments of downhole sensors that may be consistent with the present invention.

U.S. patent application Ser. No. 11/676,494, now issued U.S. Pat. No. 7,265,649 to Hall et al.; U.S. patent application Ser. No. 11/687,891, now issued U.S. Pat. No. 7,301.429 to Hall et al.; and U.S. patent application Ser. No. 12/041,754, now published U.S. Patent Publication No. 2008/0265892 to Snyder et al., each of which is herein incorporated by reference for all that it contains, disclose embodiments of induction resistivity tools.

BRIEF SUMMARY OF THE INVENTION

In one aspect of the invention, a downhole sensor system comprises at least one downhole sensor disposed on or within a downhole component of a tool string. In some embodiments, the system is a closed-loop system. The downhole sensor is adapted to detect at least one characteristic of a downhole formation adjacent the downhole component. The downhole sensor has a variable sampling rate controlled by a processing element. The processing element is in electrical communication with a tool string rate-of-penetration sensor and/or a tool string rotational speed sensor. The processing element is adapted to vary the sampling rate in response to the rate-of-penetration and/or rotational speed of the tool string. In some embodiments, the sampling rate may be varied in response to drilling dynamics, distributed measurements, weight-on-bit, torque, acceleration, or combinations thereof. The downhole sensor may be mounted in at least one radial recess in an outer wall of the downhole component or within the wall itself. In some embodiments, the sensor may be incorporated in a drill bit such as the bits disclosed in U.S. Patent Publication No. 2007/0114062, now issued U.S. Pat. No. 7,398,837 to Hall et al., which is herein incorporated by reference for all that it discloses. The sensors may also be distributed along the drill string such as is disclosed in U.S. Pat. No. 7,139,218 to Hall et al., which is also herein incorporated by reference for all that it discloses.

The downhole sensor may be adapted to sense natural gamma rays, acoustics, salinity, neutrons, a nuclear radiation, pressure, formation porosity, formation density, formation electrical conductivity, formation hardness, or combinations thereof. The downhole sensor may communicate with the processing element over a downhole network integrated into the downhole tool string. The system may be incorporated into a drilling string, a tool string, a pushed coil tubing string, a wireline system, a cable system, a geosteering system, or combinations thereof.

The system may comprise a plurality of sensors disposed discretely along an outer diameter of the downhole component. Each sensor may be adapted to detect the same formation characteristic as each of the other sensors. In some embodiments at least one of the plurality of sensors is adapted to detect a different formation characteristic than at least one other sensor.

The downhole sensor may comprise a sensor transmitter adapted to project a sensor signal into the formation and a sensor receiver adapted to detect the projected sensor signal after the signal has entered the formation. The detected sensor signal may comprise an altered signal characteristic compared to the projected signal.

The downhole sensor may comprise a plurality of adjacent sensor segments disposed continuously around at least 25% of an outer diameter of the downhole component. At least two adjacent sensor segments may be adapted to switch back and forth between a series and parallel electrical connection to one another. A location of at least one of the plurality of sensor segments may project a sensor signal into a selected portion of a formation. The sensor segments may be selectively activated to sample a selected portion of the formation. Adjacent sensor segments may be serially activated to continuously sample a selected portion of the formation. The sensor segments that are selected to be activated may be selected by the processing element in response to the rate-of-penetration and/or rotational speed of the tool string.

The downhole sensor may be a lateralog resistivity tool or an inductive resistivity tool. The downhole sensor may be adapted to project an induction signal outward from an outer diameter of the downhole component when the downhole sensor is carrying an electrical current. The downhole sensor may comprise at least one induction receiver assembly comprising at least one receiver coil wound about at least one core. In some embodiments of the invention at least part of the downhole sensor may be disposed on an outer extendable pad that extends away from an outer wall of the downhole component and toward the formation and is connected to the outer wall by an arm assembly. In some embodiments, the sampling rate is increases as the tool string as the rotational speed slows down or speeds up. The processing element may be adapted to activate a plurality of sensors to sample the formation in an axial direction. This may be accomplished when the tool string is rotating or is rotationally stationary.

DETAILED DESCRIPTION OF THE INVENTION AND THE PREFERRED EMBODIMENT

Figure 1:
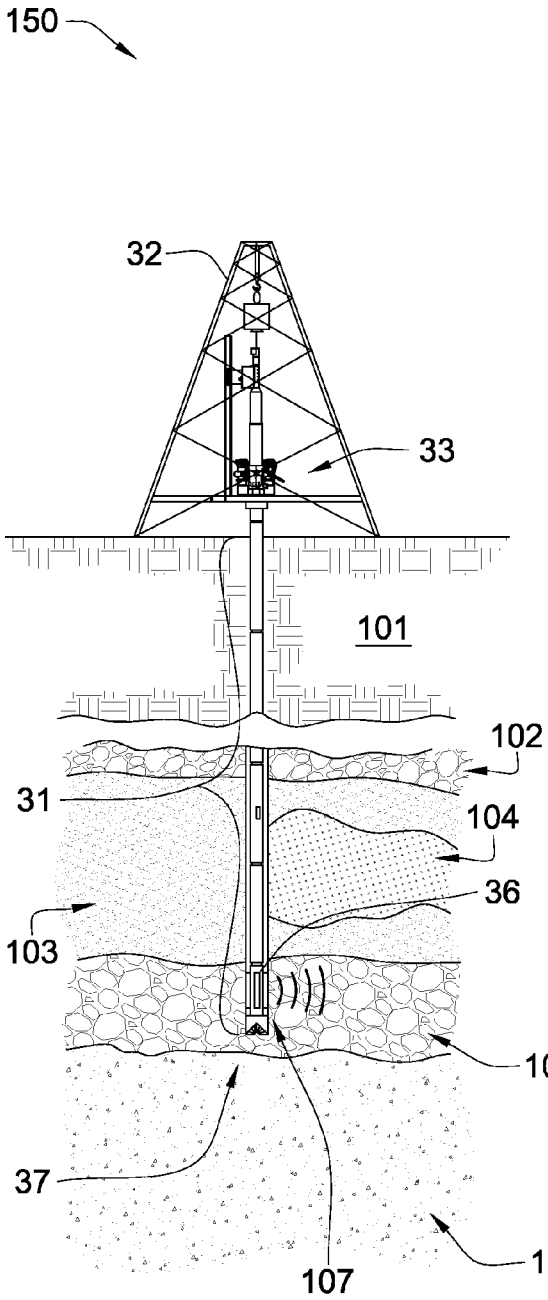
FIG. 1 is a cross-sectional diagram of an embodiment of a downhole tool string.
Figure 2:
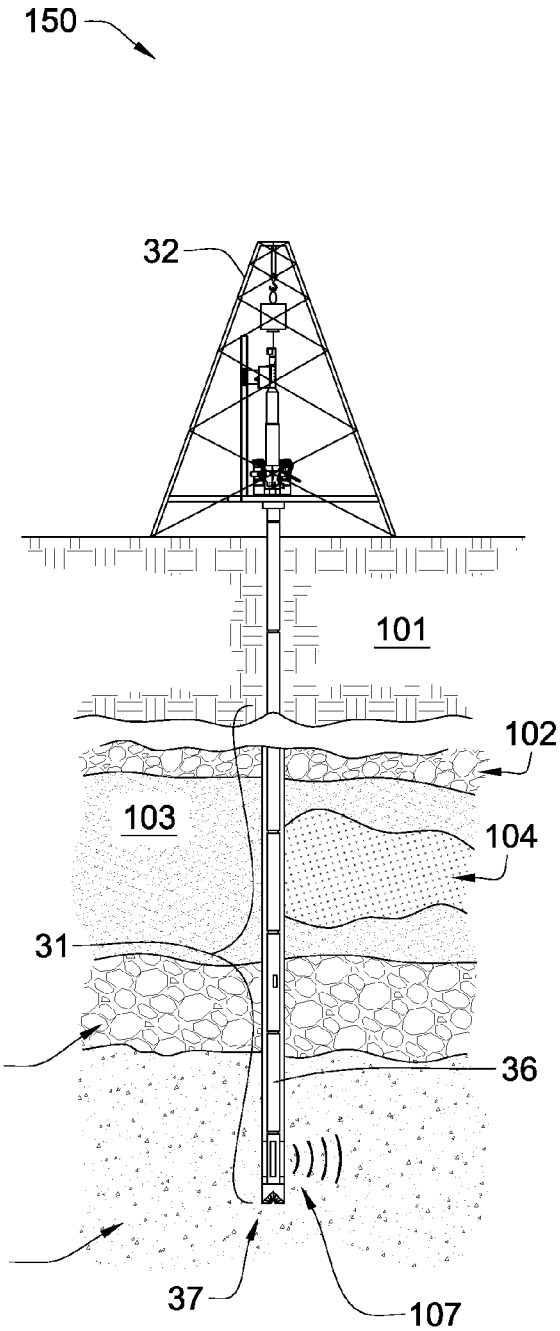
FIG. 2 is a cross-sectional diagram of another embodiment of a downhole tool string.

Referring now to FIGS. 1 and 2, a downhole tool string 31 is suspended from a derrick 32 in a drilling rig 150. The tool string 31 may comprise one or more downhole components 36, linked together in a tool string 31 and in communication with surface equipment 33 through a downhole network or the tool string may comprise another telemetry system such as mud pulse or electromagnetic waves. The tool string 31 is depicted in a vertical drilled hole but it may be at any angle including horizontal. In FIGS. 1 and 2 a plurality of formation strata 101, 102, 103, 104, 105, and 106 are shown. The tool string 31 in FIG. 1 extends into formation strata 101, 102, 103, 104, and 105, but not into formation stratum 106. In FIG. 2 the tool string 31 extends into all formation strata 101-106.

The tool string 31 or surface equipment 33 may comprise an energy source or multiple energy sources. The energy source may transmit electrical current to one or more downhole components 36 on the bottom hole assembly 37 or along the tool string 31. At least one downhole sensor 107 is disposed on or within one or more downhole components 36 of the tool string 31. The sensor is adapted to detect at least one characteristic of a downhole formation adjacent the downhole component or a downhole drilling condition In FIG. 1 the downhole sensor 107 may detect at least one formation characteristic from formation stratum 105. In FIG. 2 the downhole sensor 107 may detect at least one formation characteristic from formation stratum 106. In some embodiments the downhole sensor 107 may detect a change in formation characteristic adjacent the component 36 that indicates a transition of the sensor from one stratum 101-105 to the next stratum 102-106. The downhole sensor 107 may be adapted to sense natural gamma rays, acoustics, salinity, neutrons, a nuclear radiation, radioactive energy, pressure, formation porosity, formation density, formation electrical conductivity, formation electrical resistivity, formation hardness, or other drilling dynamics measurements or combinations thereof from the formation being drilled. In some embodiments multiple downhole components 36 may each comprise at least one downhole sensor 107.

The downhole sensor 107 comprises a sampling rate defined by the number of formation characteristic data points obtained by the sensor in a given amount of time. In the present embodiment the downhole sensor 107 comprises a variable sampling rate, indicating that the number of formation characteristic data points obtained by the sensor in a given amount of time may be increased or decreased. Sampling rate variability may be desired as tool strings 31 enter new formation strata 101-106 as the characteristics of the strata 101-106 may vary from one another. Varying the sampling rate may optimize the amount and quality of data obtained through the downhole sensor, as well as minimizing the nonessential use of energy in the sensor.

Because rate-of-penetration (ROP) and rotational speed (RS) of the tool string are two indicators of types of tool string movement in relation to the formation targeted for sampling, these parameters may be important for determining ideal sampling rates in real-time. Also, sensors with a non-variable sample rate generally may rely on the RS for their sampling rate of a selected portion of the formation. For example, the sensor may sample the selected portion of the formation once for each complete rotation of the tool string 31. Varying the sampling rate in response to the RS may allow sampling of the selected portion of the formation to be independent of the RS in the sense that a lower RS need not necessitate a lower sampling rate. For example, the variable . . . sampling rate may be increased to respond to the slower RS to keep the original sampling rate constant.

Having a network in the tool string 31 may enable high-speed communication between each device connected to it and facilitate the transmission and receipt of data between downhole sensors 107 and data processing elements or between energy sources and energy receivers. Data may be transmitted along the tool string 31 through techniques known in the art. A preferred method of downhole data transmission using inductive couplers disposed in tool joints is disclosed in the U.S. Pat. No. 6,670,880 to Hall, et al., which is herein incorporated by reference for all it discloses. An alternate data transmission path may comprise direct electrical contacts in tool joints such as in the system disclosed in U.S. Pat. No. 6,688,396 to Floerke, et al., which is herein incorporated by reference for all that it discloses. Another data transmission system that may also be adapted for use with the present invention is disclosed in U.S. Pat. No. 6,641,434 to Boyle, et al., which is also herein incorporated by reference for all that it discloses.

In some embodiments, of the present invention alternative forms of telemetry may be used to communicate with the downhole components 36, such as telemetry systems that communicate through the drilling mud or through the earth. Such telemetry systems may use electromagnetic or acoustic waves. The alternative forms of telemetry may be the primary telemetry system for communication with the tool string 31 or they may be back-up systems designed to maintain some communication if the primary telemetry system fails. A data swivel 34 or a wireless top-hole data connection may facilitate the transfer of data between components 36 of the rotatable tool string 31 and a non-rotating drilling rig 150. Preferably the downhole tool string 31 is a drill string. In other embodiments the downhole tool string 31 is part of a coiled tubing logging system, a pushed coil tubing string, a wireline system, a cable system, a geosteering system, a production well, or combinations thereof.

Figure 3:
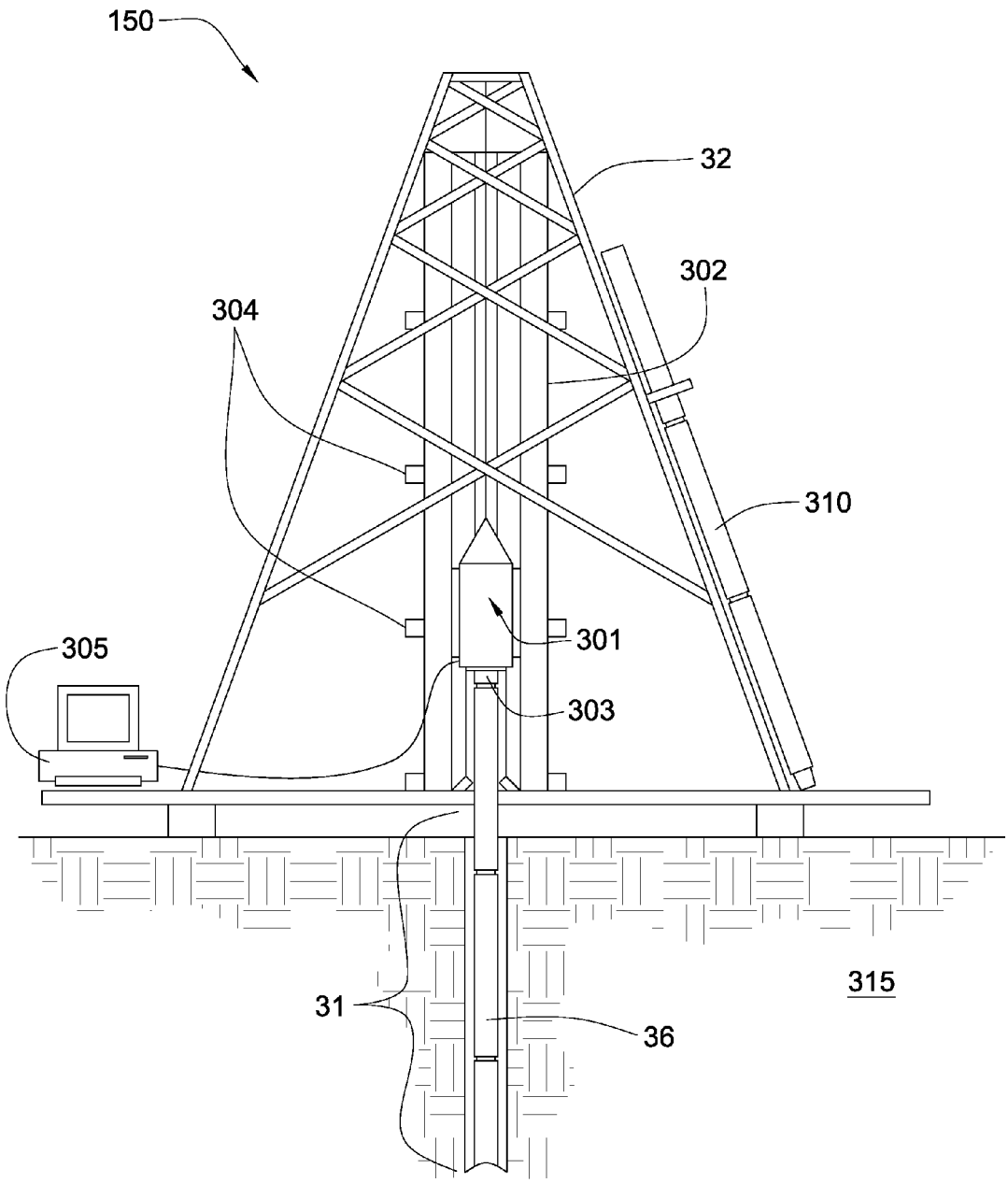
FIG. 3 is an orthogonal diagram of an embodiment of drilling rig.

FIG. 3 discloses an embodiment of a drilling rig 150 comprising a top drive 301 connected to the derrick 32 through a vertical support 302. The drilling rig 150 also comprises an additional tool string component 310 that may be incorporated into the tool string 31 to elongate the tool string 31. The top drive 301 is adapted to translate vertically along the vertical support 302 as well as to rotate the tool string 31 through a first tool string component 303 to which the drive 301 is connected. The top drive may comprise a rotational speed sensor that indicates the speed at which the first tool string component 303 is being rotated. In some embodiments of the invention a rotational speed sensor may be disposed in a downhole tool string component 36 and may comprise an accelerometer. The vertical support 302 comprises a plurality of position sensors 304 adapted to detect the presence of the top drive 301 when the drive 301 is close to the position sensor 304. Position data may be obtained and recorded in real time and compared to determine a rate-of-penetration of the drill string 31 into the formation 315. The position sensors 304 may together constitute a rate-of-penetration sensor.

A processing element 305 may be in communication with the downhole tool string components 36 through a downhole network as discussed previously and/or through an electrically conductive medium. For example, a coaxial cable, wire, twisted pair of wires or combinations thereof may travel from the surface to at least one downhole tool string component. The mediums may be in inductive or electrical communication with each other through couplers positioned so as to allow signal transmission across the connection of the downhole component and the tool string. The couplers may be disposed within recesses in either a primary or secondary shoulder of the connection or they may be disposed within inserts positioned within the bores of the drill bit assembly and the downhole tool string component 36. As the control equipment receives information indicating specific formation qualities, the control equipment may then change drilling parameters according to the data received to optimize drilling efficiency. Operation of the drill string 31 may include the ability to steer the direction of drilling based on the data either manually or automatically.

Figure 4:
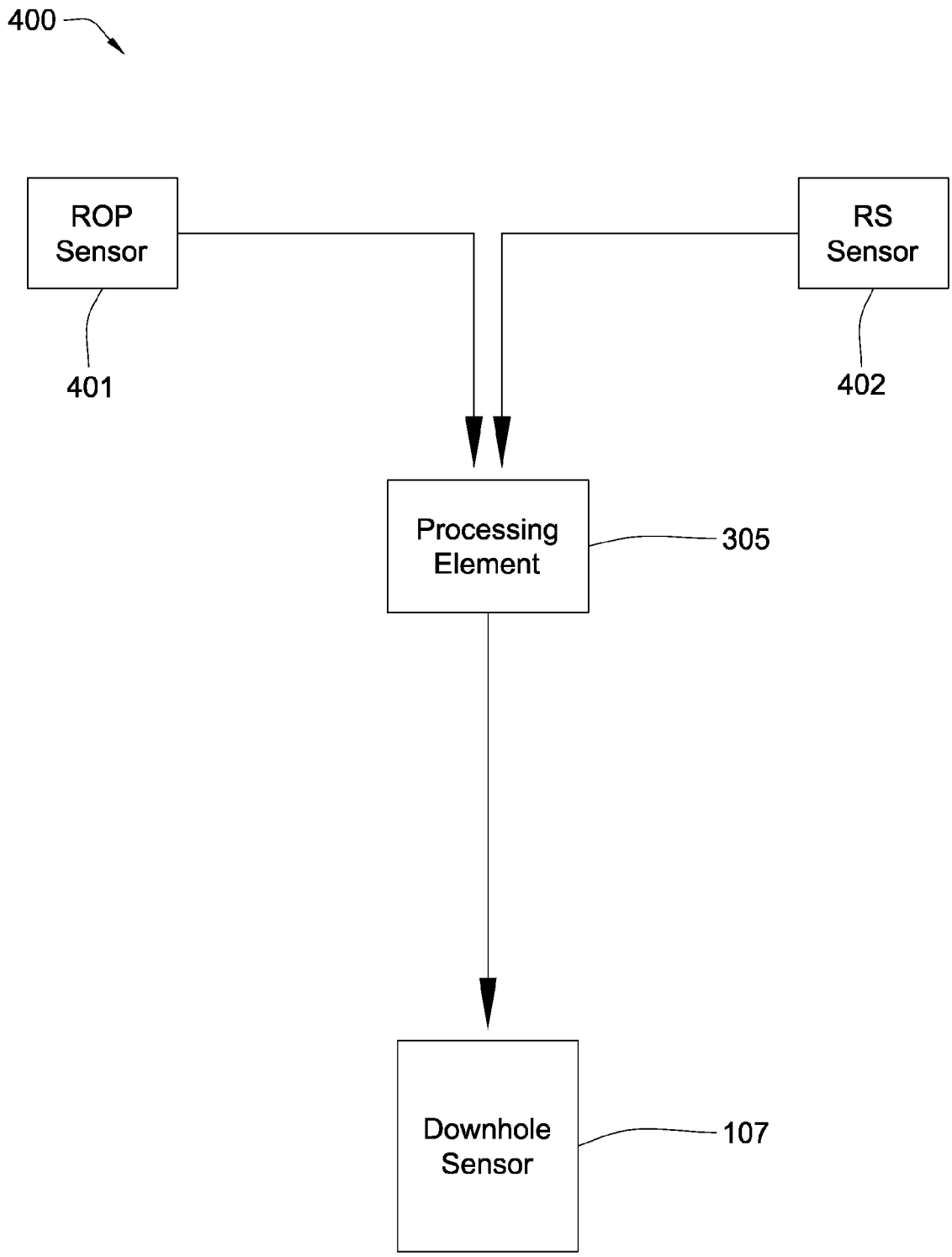
FIG. 4 is a flow-chart of an embodiment of downhole sensor system.

FIG. 4 discloses a schematic diagram depicting a closed-loop downhole sensor system 400 comprising at least one downhole sensor 107 being in two-way electrical communication with a processing element 305. The processing element is in electrical communication with a tool string rate of penetration (ROP) sensor 401 and with a tool string rotational speed (RS) sensor 402. The downhole sensor 107 has a variable sampling rate that is controlled by the processing element 305 in response to the ROP sensor 401 and/or the RS sensor 402.

Figure 5:
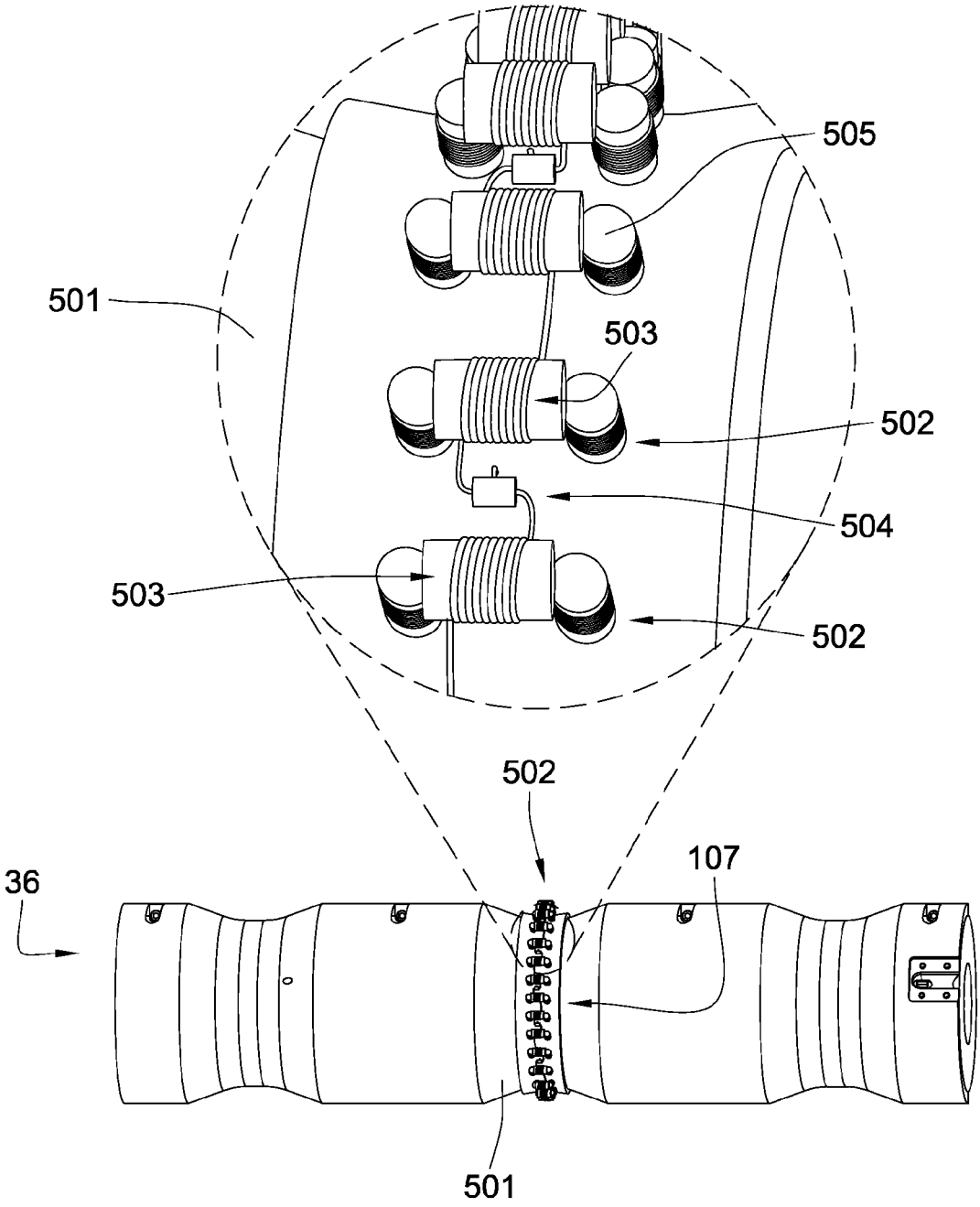
FIG. 5 is a perspective diagram of an embodiment of a downhole sensor.

FIG. 5 discloses an embodiment of a downhole component 36 comprising a radial recess 501. A downhole sensor 107 is mounted in the radial recess 501. The downhole sensor 501 comprises a plurality of adjacent sensor segments 502 that are disposed continuously around an entire outer diameter of the downhole component 36. In some embodiments the plurality of adjacent sensor segments 502 may be disposed continuously around at least 25% of the entire outer diameter of the downhole component 36. In some embodiments, the sensors may span less than 25% of the outer diameter. Also in FIG. 5, at least two adjacent sensor segments 502 are adapted to switch back and forth between a series and parallel electrical connection to one another. In the present embodiment each sensor segment 502 comprises a coil 503 wound about a magnetic core 505. The coils 503 on each of the at least two adjacent segments 502 are connected through a switchbox 504. The switch box 504 may also be connected to an electrical current source. To put the two adjacent segments 502 into a series connection the switchbox 504 may electrically connect the coils 503 of the adjacent segments to one another. To create a parallel connection the switchbox 504 may electrically disconnect the coils 503 of the adjacent segments 502 and introduce the electrical current from the electrical current source to one of the two adjacent segments 502. The other of the two adjacent segments 502 may already be electrically connected to the electrical current source. The switchbox connection and disconnection of the two coils may be controlled by the processing element 305. Each sensor segment 502 may sense a formation characteristic from a limited portion of the formation 315 when the coil 503 on that segment 502 is carrying an electrical current. By using the switchboxes 504 to control which segment coils 503 are carrying electrical current, a selected portion of the formation 315 may be sampled for the specified formation characteristic.

Figure 6:
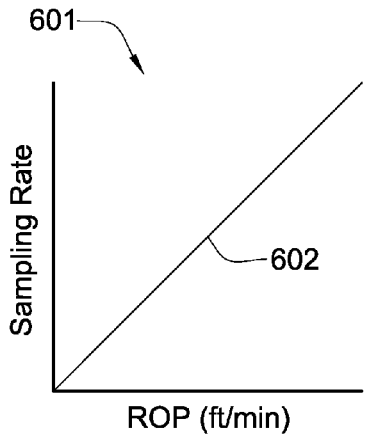
FIG. 6 is a graphical diagram relating sampling rate and rate of penetration.
Figure 7:
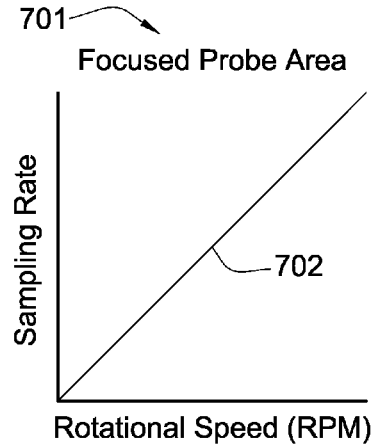
FIG. 7 is a graphical diagram relating sampling rate and rotational speed.
Figure 8:
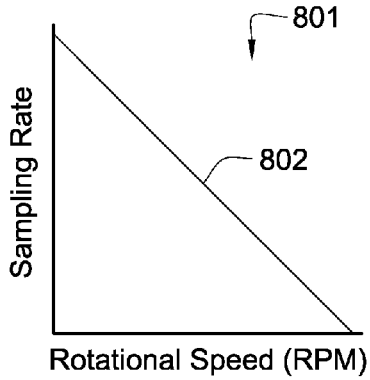
FIG. 8 is a graphical diagram relating sampling rate and formation hardness.

FIGS. 6-10 describe graphs disclosing possible variation relationships that the processing element 305 may follow when it varies the sampling rate of the downhole component 36 in response to the ROP and/or rotational speed (RS) of the tool string 31 as indicated by the ROP sensor 401 and/or the RS sensor 402. In FIG. 6 the graph 601 discloses a positive and direct correlation 602 between ROP and sampling rate. As the ROP of the tool string increases, the processing element 305 may increase the sampling rate in order to maintain an accurate representation of the formation 315 that the drill bit of the string is currently drilling into. When the ROP decreases the sampling rate may be decreased by the processing element 305 in order to conserve energy expended in the sampling process. The graph 701 in FIG. 7 discloses a positive and direct correlation 702 between rotational speed of the tool string and the sampling rate of the downhole sensor 107. In such embodiments the rotational speed may correspond to the ROP. FIG. 8 discloses a graph 801 showing a direct negative relationship 802 between rotational speed and sampling rate. Some formations 315 may require a greater rotational speed without a resultant increase in ROP. In such circumstances the processing element 305 may decrease the sampling rate to conserve energy, memory, battery life, and money. Energy conservation may not only be achieved by minimizing the amount of unnecessary sensor sampling itself, but also in transmitting unnecessary sampling data to the processing element 305.

Figure 9:
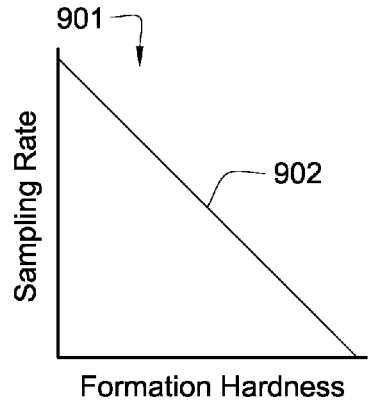
FIG. 9 is a graphical diagram relating sampling rate and rotational speed.
Figure 10:
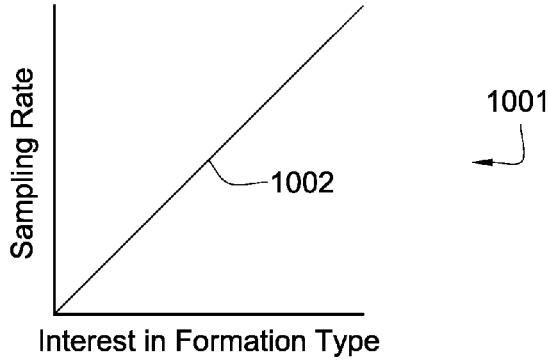
FIG. 10 is a graphical diagram relating sampling rate and interest in formation type.

FIG. 9 discloses a graph 901 showing an inverse correlation 902 between formation hardness and sampling rate. Harder formations 315 may require more drilling time to penetrate, resulting in a decrease in ROP. The processing element may decrease the sampling rate in harder formations to conserve energy. The graph 1001 in FIG. 10 discloses a positive direct correlation 1002 between interest in formation type and sampling rate. If the drill bit is known to be in a formation type that is believed to be especially rich in oil and gas reservoirs, the processing element 305 may increase the sampling rate to more precisely detect such reservoirs.

Figure 11:
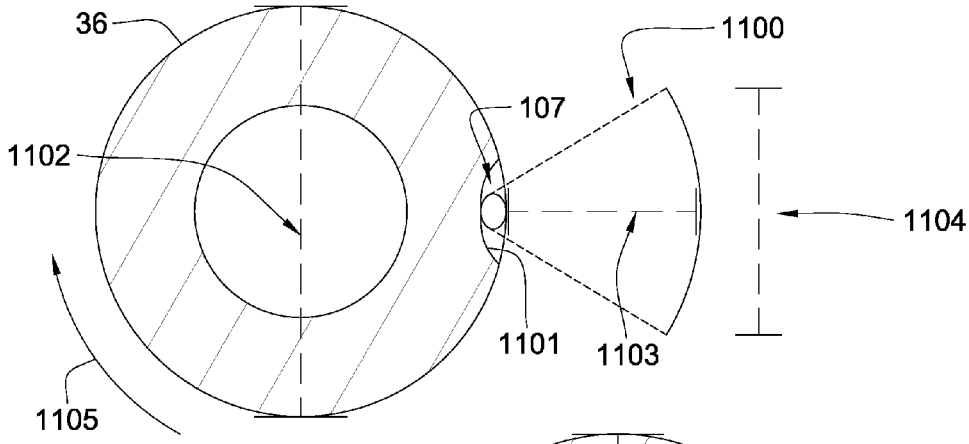
FIG. 11 is a cross-sectional diagram of an embodiment of a downhole component.

FIG. 11 discloses an embodiment of a downhole sensor 107 that projects a sensor signal 1100 into a selected portion of a formation 315. The downhole sensor 107 is disposed in a recess 1101 in an outer diameter 1102 of the downhole component 36. The selected portion of the formation 315 is limited by a sampling range 1103 and a sampling breadth 1104 of the downhole sensor 107. In some embodiments of the invention the sampling range 1103 and sampling breadth 1104 may be adjusted by increasing or decreasing a flow of electrical current into the downhole sensor 107. In some embodiments the downhole sensor 107 may operate independent of electrical current. The downhole component 36 may rotate in the direction indicated by arrow 1105 at a rotational speed detected by an RS sensor 402. The downhole sensor 107 may be continuously activated as the downhole component 36 rotates 360 degrees around a central axis of the component 36. In some embodiments the downhole sensor 107 may sample the formation 315 at discrete points along the rotation. This may be useful in drilling applications where the tool string rests against the bore hole, such as in horizontal and directional drilling applications. As the tool string rotates the sensors will come in and out of contact with the side of the bore hole which is in contact with the tool string. In these applications it may be desirable to control the sampling rate such that the sensors only sample when they are in the general proximity of the side of the bore hole in contact with the tool string. In other applications, such as geosteering through a reservoir, the sampling may be controlled to sample when the sensors rotate towards the "high" or "low" side of the reservoir for monitoring gas, oil, and/or water concentrations.

Figure 12:
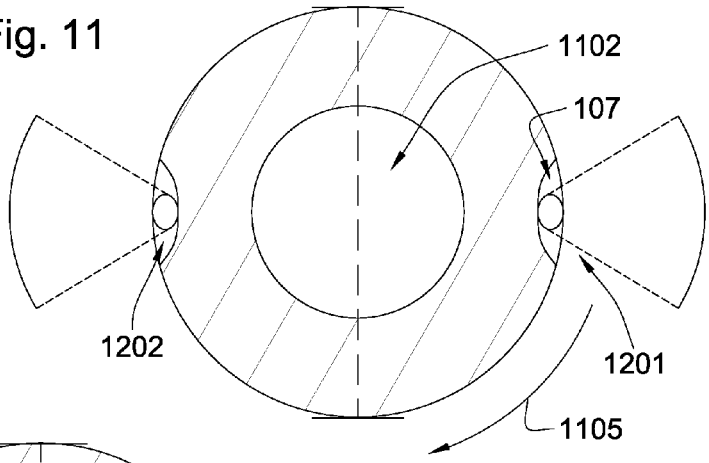
FIG. 12 is a cross-sectional diagram of another embodiment of a downhole component.

Referring now to FIG. 12, the close-loop downhole sensor system 400 comprises a plurality of downhole sensors 107 that are disposed discretely along the outer diameter 1102 of a downhole component 36. In FIG. 12 the downhole component comprises first and second downhole sensors 1201, 1202 disposed on opposite ends of a single outer diameter 1102 of the downhole component 36. A sensor system 400 comprising twice as many sensors along the same outer diameter 1102 of the downhole component 36 may have double the combined formation sampling rate as a standard sensor system 400 when operated under the same conditions. In some embodiments of the invention the processing element 305 may control the sampling rate of both the first and second downhole sensors 1201, 1202 to create a combined sampling rate for the sensor system 400. In such embodiments each sensor 1201, 1202 may be adapted to detect the same formation characteristic, or in some embodiments, at least one downhole sensor 305 may be adapted to detect a different formation characteristic than at least one other. For example, the first sensor 1201 may detect natural gamma rays and the second sensor 1202 may detect formation porosity.

Figure 13:
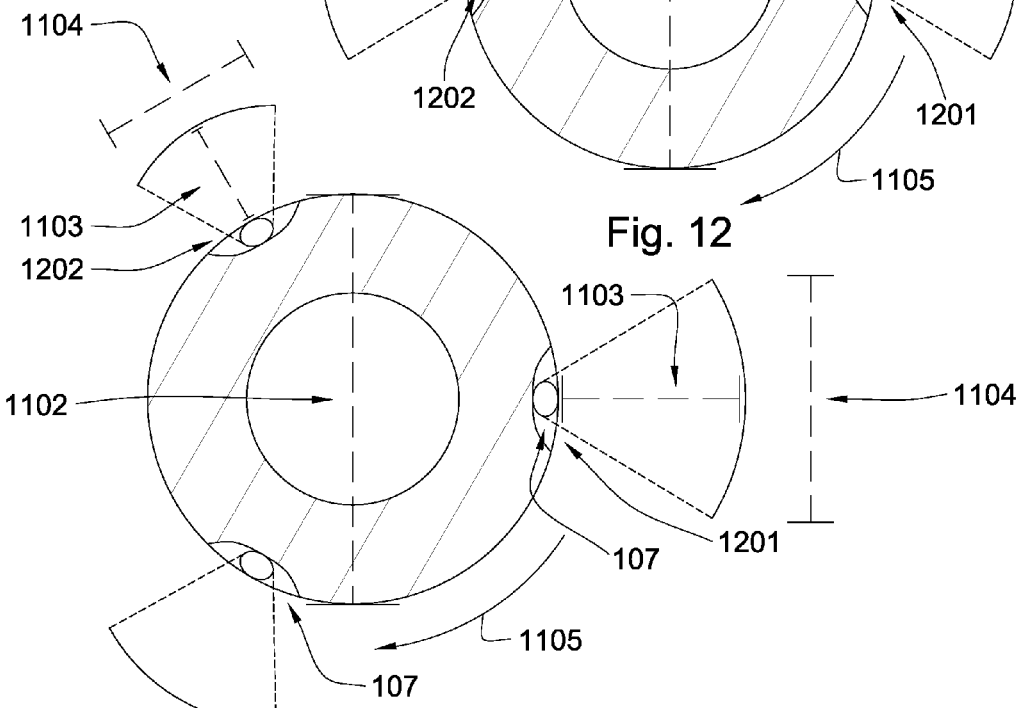
FIG. 13 is a cross-sectional diagram of another embodiment of a downhole component.

Referring now to FIG. 13, a first downhole sensor 1201 comprises a larger sampling range 1103 and sampling breadth 1104 than the sampling range 1103 and breadth 1104 of a second downhole sensor 1202. The downhole component in FIG. 13 also discloses an embodiment in which a plurality downhole sensors 107 is disposed equidistantly around the outer diameter 1102 of the component 36. In some embodiments of the invention two or more downhole sensors 107 may be closer to one another than each one is to at least one other downhole sensor 107.

Figure 14:
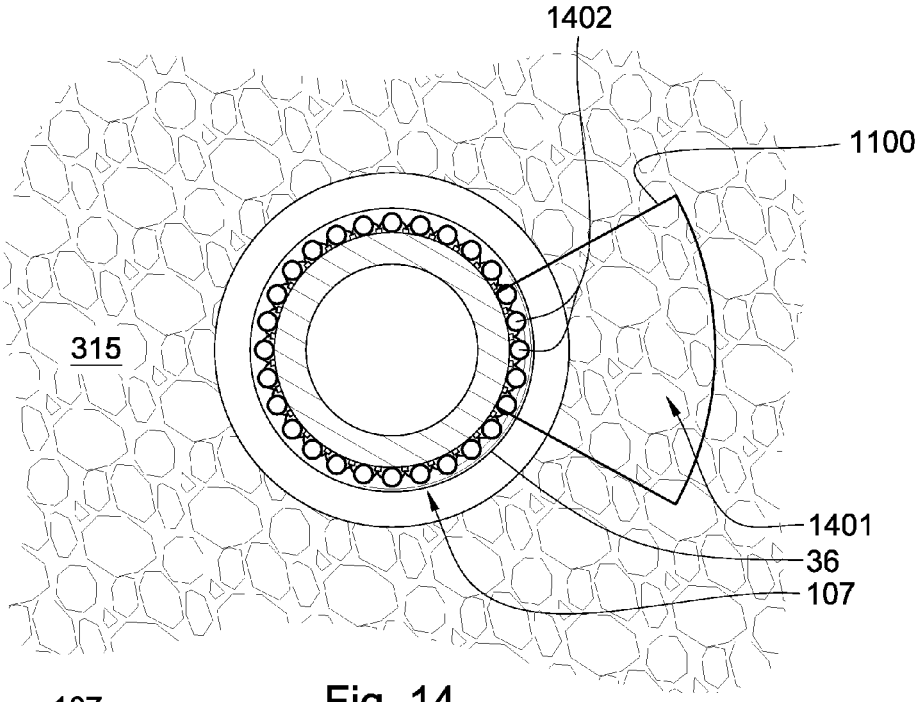
FIG. 14 is a cross-sectional diagram of another embodiment of a downhole component.
Figure 15:
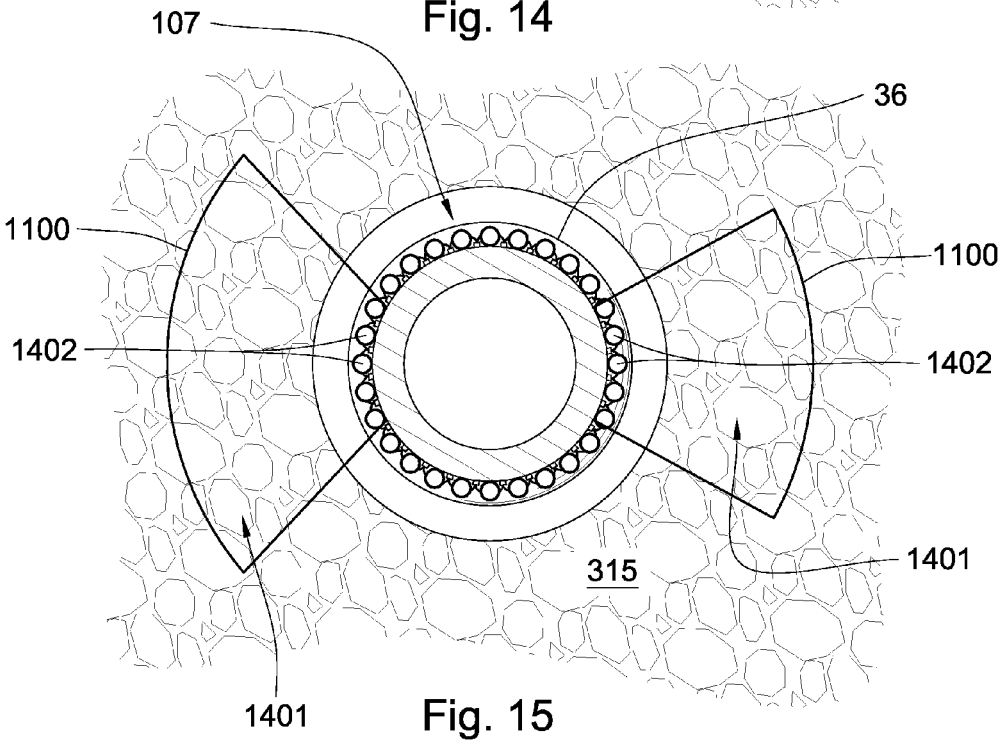
FIG. 15 is a cross-sectional diagram of another embodiment of a downhole component.

Referring now to FIGS. 14 and 15, embodiments of the invention are disclosed in which a downhole sensor 107 comprising a plurality of activated sensor segments 1402 projects a sensor signal 1100 into a selected portion 1401 of the formation 315. In FIG. 14 the location of activated sensor segments 1402 directs the sensor signal into the particular selected portion 1401 of the formation 315. The activated sensor segments 1402 may be selectively activated to sample the selected portion 1401 of the formation 315. In FIG. 15 the selected portion 1401 of the formation 315 is disposed discretely on opposite sides of the downhole component by selectively activating sensor segments 502 on opposite sides of the downhole component. As shown in FIG. 15, the size of the selected portion 1401 on each side of the component 36 may be different. In some embodiments the size of the selected portion 1401 on each side of the component 36 may be the same.

Figure 16:
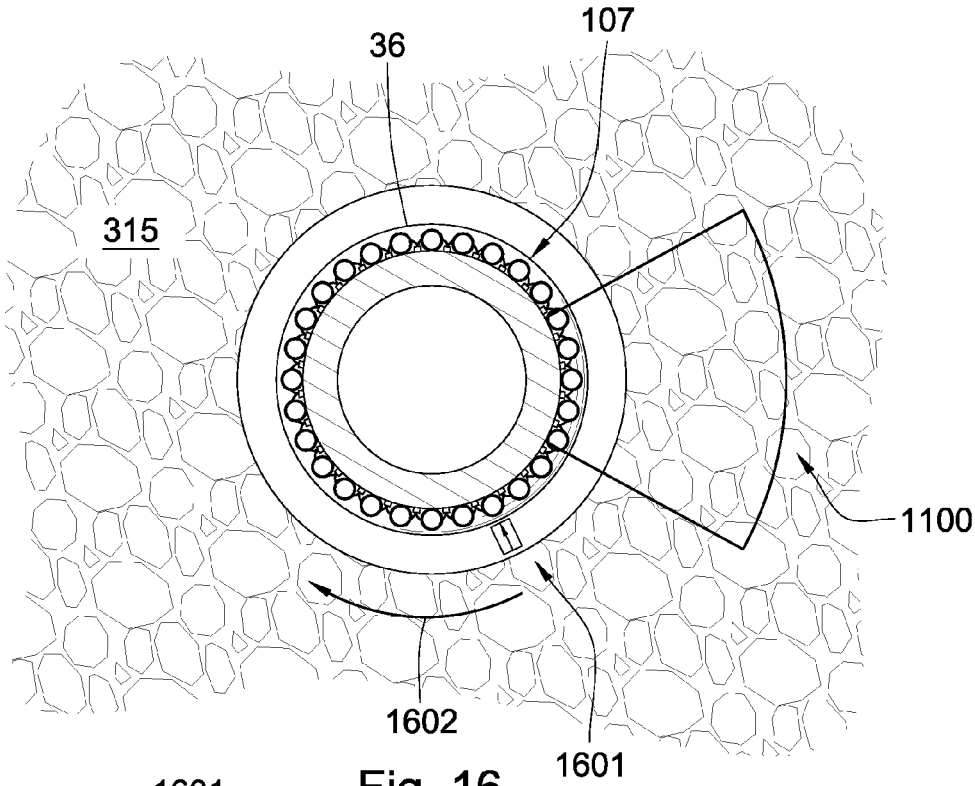
FIG. 16 is a cross-sectional diagram of another embodiment of a downhole component.
Figure 17:
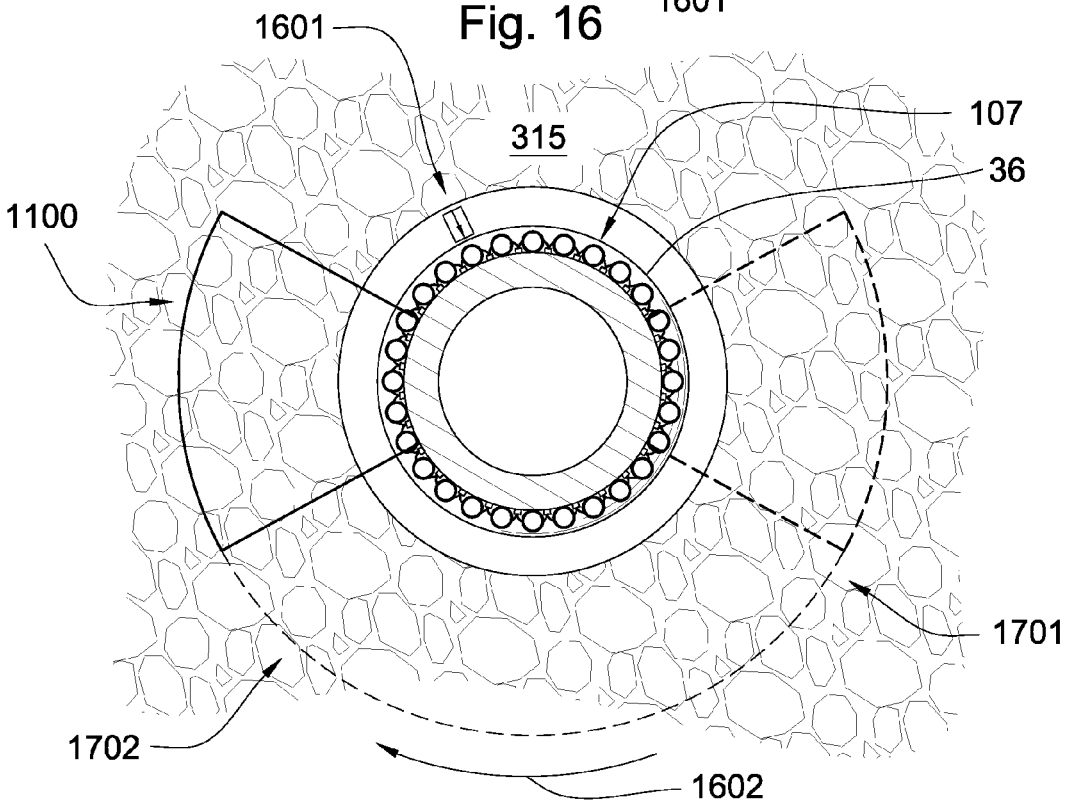
FIG. 17 is a cross-sectional diagram of another embodiment of a downhole component.

Referring now to FIGS. 16 and 17, as the component shown in FIG. 16 rotates in the direction of the arrow 1602 the sensor signal 1100 may sweep through the formation 315 in a continuous path. For purpose of illustration a reference point indicated by a boxed arrow 1601 shows that the embodiments of FIGS. 16 and 17 are rotated with respect to one another. The dotted lines 1701 in FIG. 17 together with the sensor signal 1100 illustrate the total selected portion 1702 of the formation 315 in the present embodiment. If the tool string is penetrating further down into the formation 315, rather than comprising a generally circular two-dimensional geometry after one complete rotation of the tool string 36, the selected portion 1702 of the formation 315 may comprise a generally helical three-dimensional geometry in the formation 315.

Figure 18:
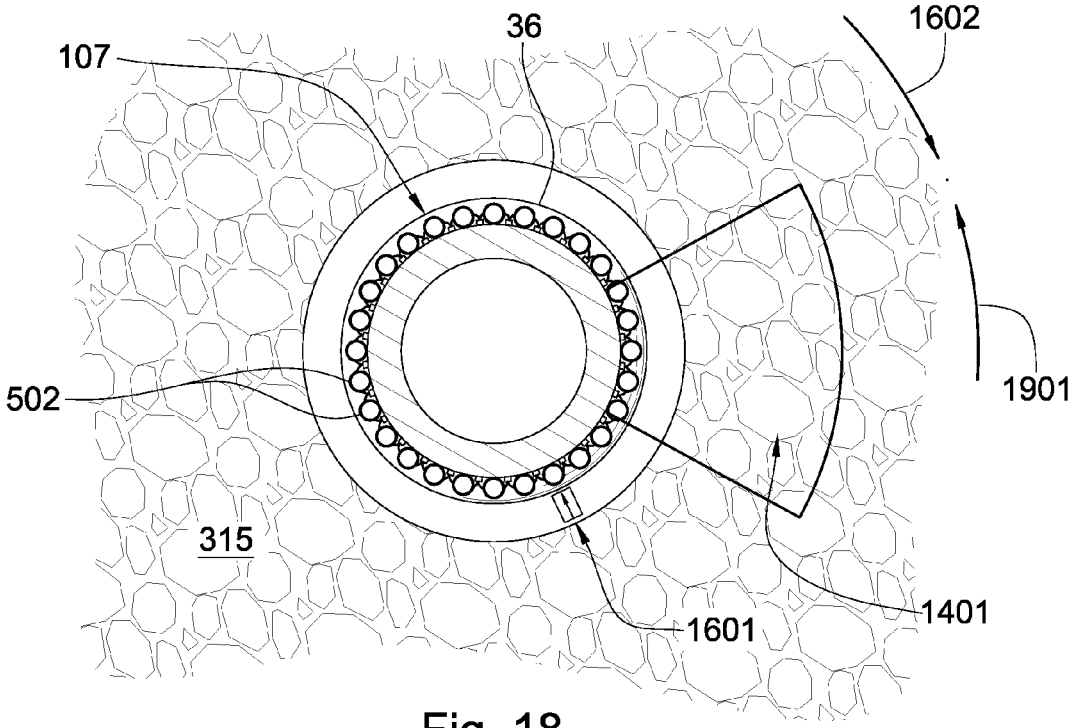
FIG. 18 is a cross-sectional diagram of another embodiment of a downhole component.
Figure 19:
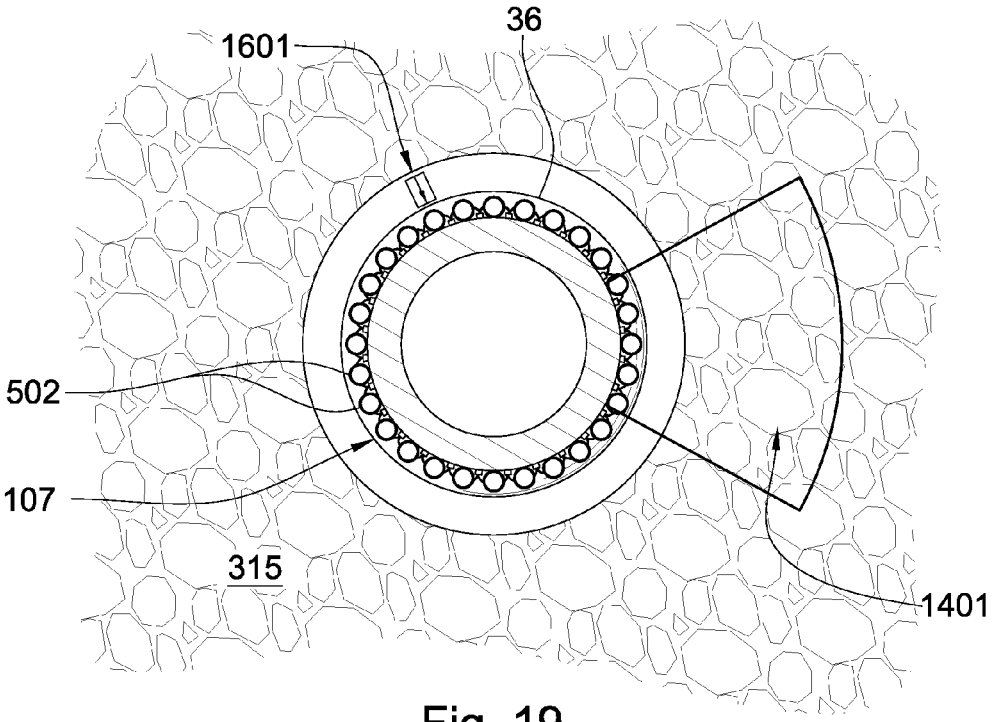
FIG. 19 is a cross-sectional diagram of another embodiment of a downhole component.

Referring now to FIGS. 18 and 19, the selected portion 1401 of the formation 315 remains constant between FIGS. 18 and 19 despite rotation of the component 36 in the direction of the arrow 1602. The orientations of the downhole component 36 in FIGS. 18 and 19 can be compared in relation to the reference point 1601. Adjacent sensor segments 502 may be serially activated at the same seed as the rotation of the downhole component 36, but the segments 502 may be activated in a direction 1901 opposite the direction 1602 of rotation of the tool string. This may allow the downhole sensor to continuously sample a selected portion 1401 of the formation 315 independent of the rotation of the downhole component 36.

The downhole sensor may serially activate each sensor segment 502 to generate one 360 degree sweep of the formation. In some embodiments the 360 degree sweep of the formation may occur faster or slower than a single 360 degree rotation of the downhole component 36. This may be accomplished by serially activating adjacent sensor components 502 at a speed faster or slower than would be required to maintain a constant selected portion 1401, which constant selected portion 1401 was described previously in the description of FIGS. 18 and 19.

The processing element 305 may select specific sensor segments 502 to be activated and/or deactivated in response to the ROP and/or rotational speed of the tool string 31. In some embodiments, serially activating adjacent sensor segments 502 may allow the downhole sensor 107 to continue to selectively sample the formation 315 on opposite sides of the downhole component 36 even when the component 36 is not itself rotating.

Figure 20:
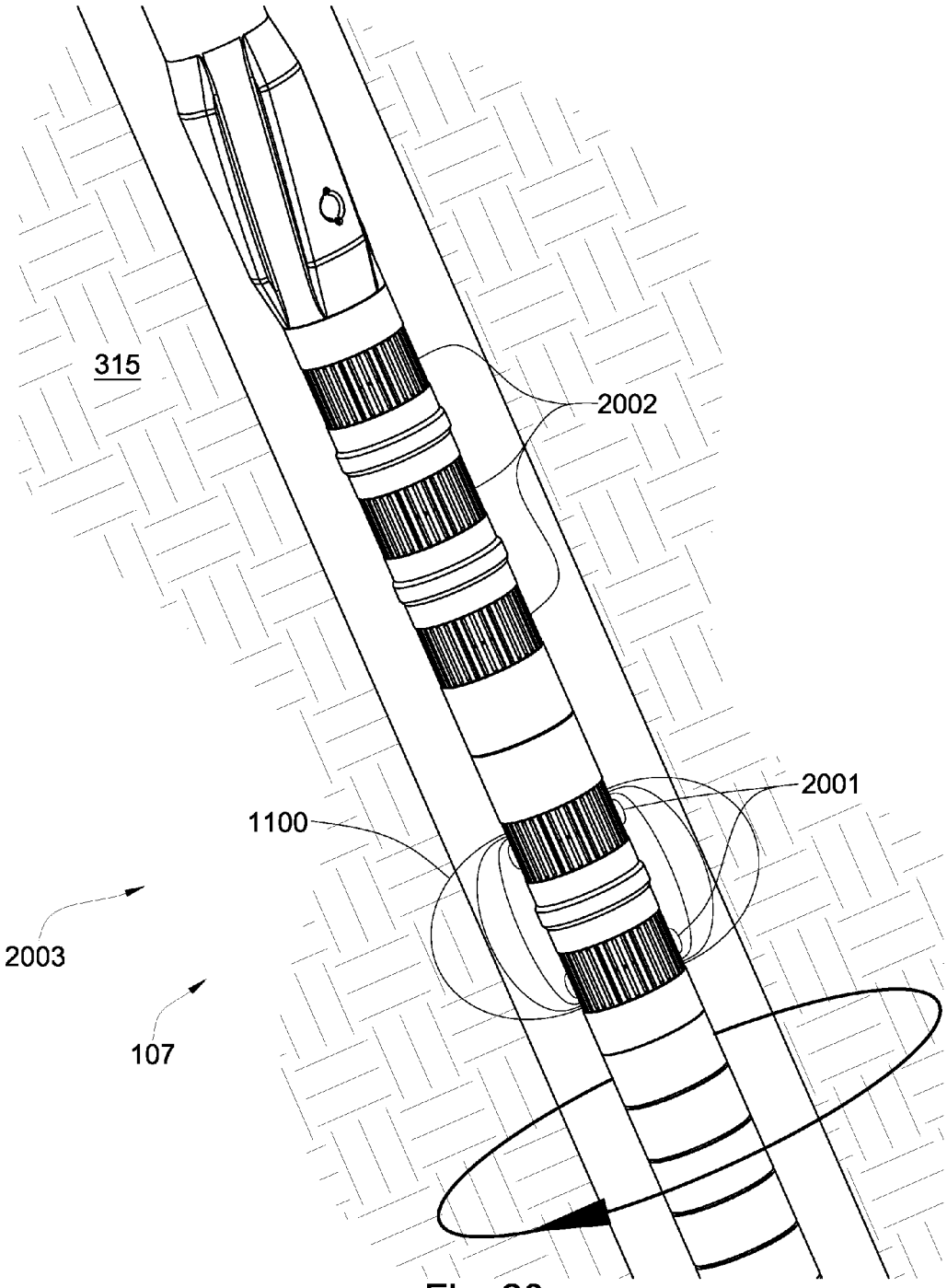
FIG. 20 is a perspective diagram of an embodiment of an induction resistivity tool.
Figure 21:
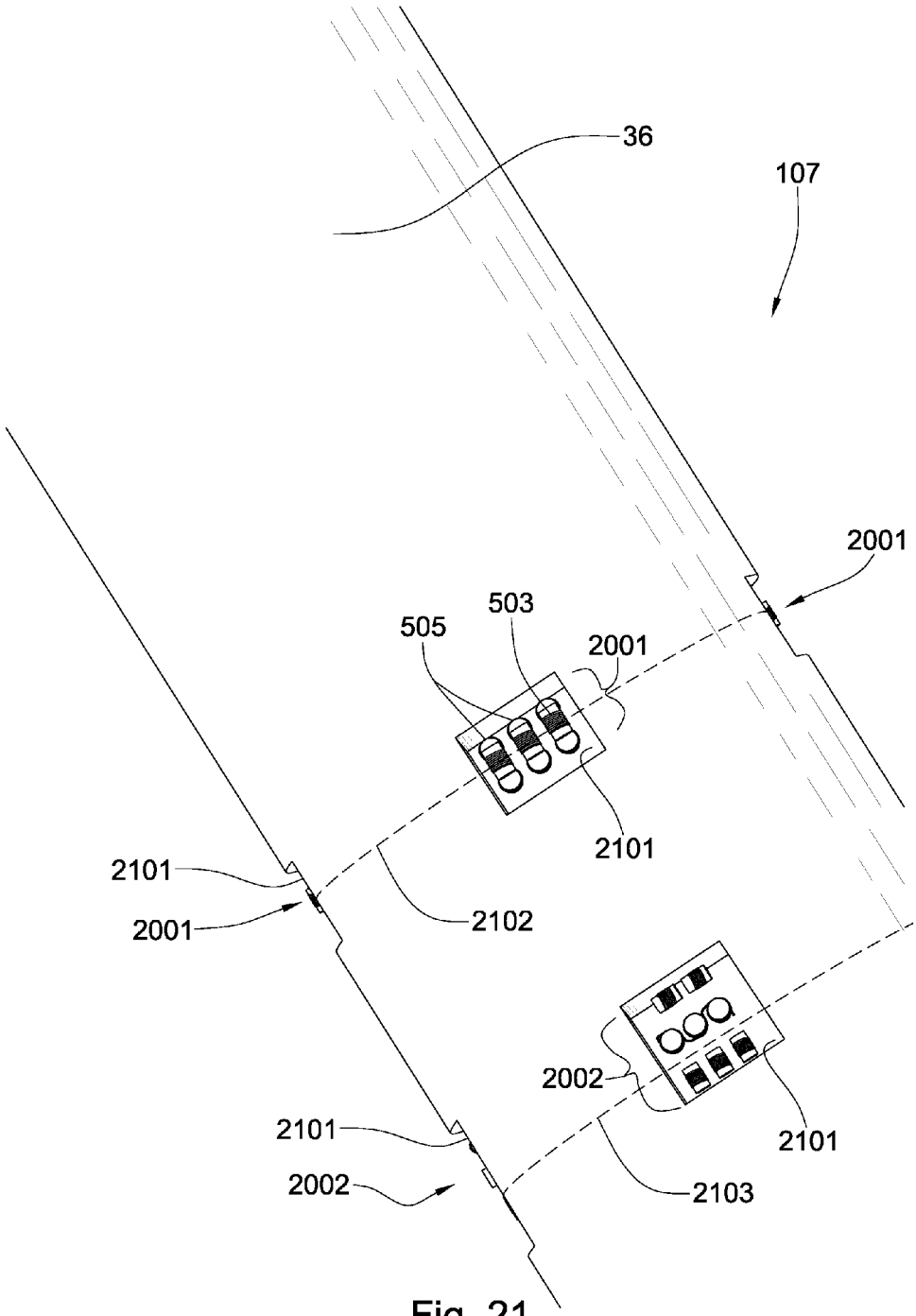
FIG. 21 is a perspective diagram of another embodiment of a downhole component.
Figure 22:
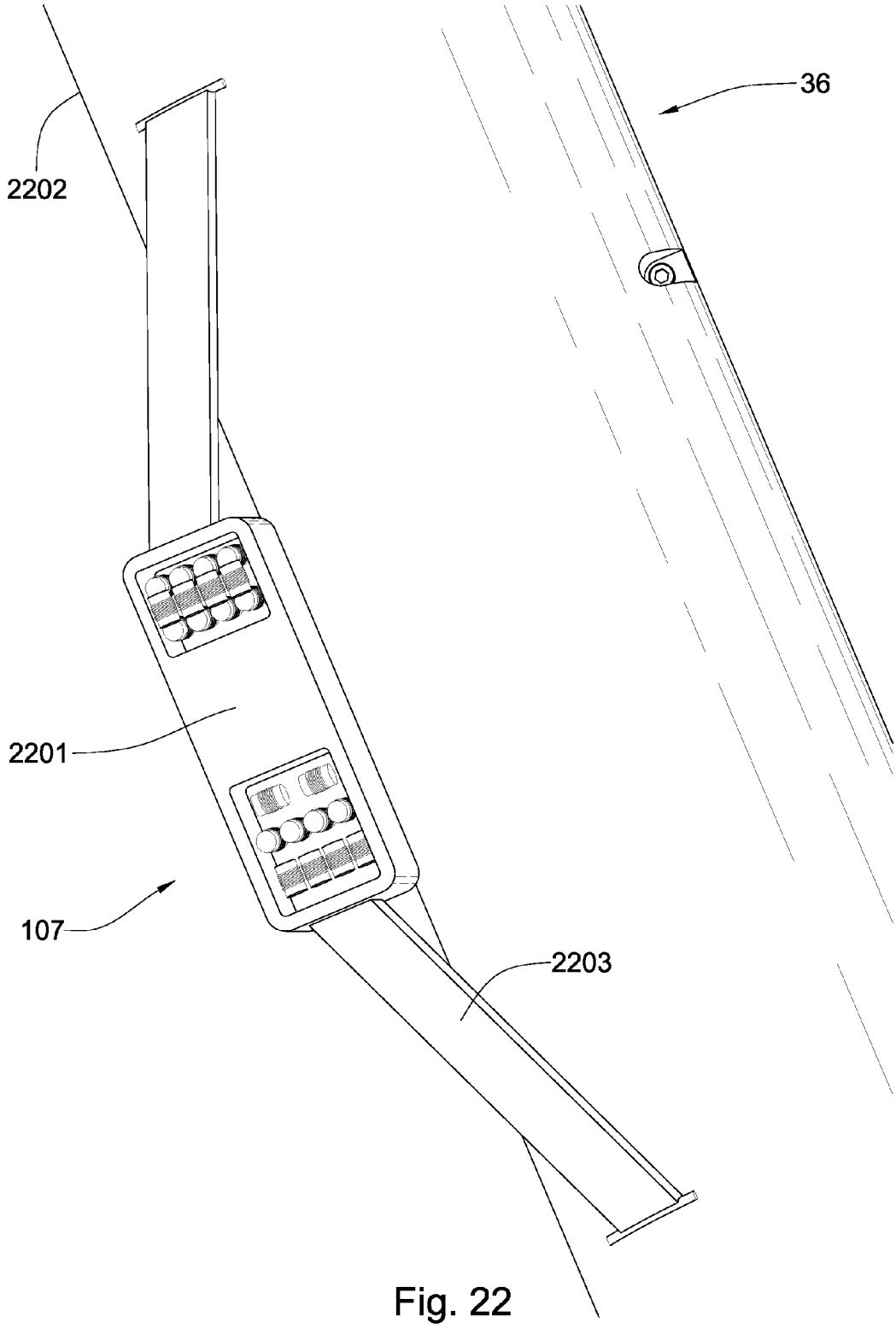
FIG. 22 is a cross-sectional diagram of an embodiment of a pad attached downhole component.

FIGS. 20-22 disclose embodiments of the invention in which the downhole sensor 107 comprises a sensor transmitter 2001 adapted to project a sensor signal 1100 into the formation 315 and a sensor receiver 2002 adapted to detect the projected sensor signal after the signal has entered the formation 315. In some embodiments the detected signal may comprise an altered signal characteristic compared to the projected signal 1100. The altered signal characteristic may indicate something about at least one formation characteristic proximate the downhole sensor 107. In FIG. 20 the downhole sensor 107 is a resistivity tool 2003 and the altered signal characteristic may be interpreted to determine the resistivity or conductivity of the formation 315. Although in FIG. 20 an inductive resistivity tool 2003 is shown, other types of later-log resistivity tools may be employed consistent with the present invention.

In FIG. 21 a downhole sensor 107 comprising a plurality of sensor transmitters 2001 and a plurality of sensor receivers 2002 is disclosed. Each transmitter 2001 and receiver 2002 is disposed in a separate discrete recess 2101, with each of the sensor transmitters 2001 being disposed along a first diameter 2102 of the downhole component at each of the sensor receivers 2002 being disposed along a second diameter 2103. The downhole sensor in FIG. 21 comprises at least one coil 503 wound about plurality of magnetic cores 505. When the resistivity tool 2003 is carrying an electrical current through the coil 503, this downhole sensor 107 may then project an induction signal outward from an outer diameter of the downhole component 36.

FIG. 22 discloses an embodiment in which at least part of the downhole sensor 107 is disposed on an outer extendable pad 2201 that extends away from an outer wall 2202 of the downhole component 36 and toward the formation 315. The pad 2201 is connected to the outer wall by an arm assembly 2203. In some embodiments, the pad may be hinged or may be adapted to extend radially outward for better communication with the downhole formation.

Figure 23:
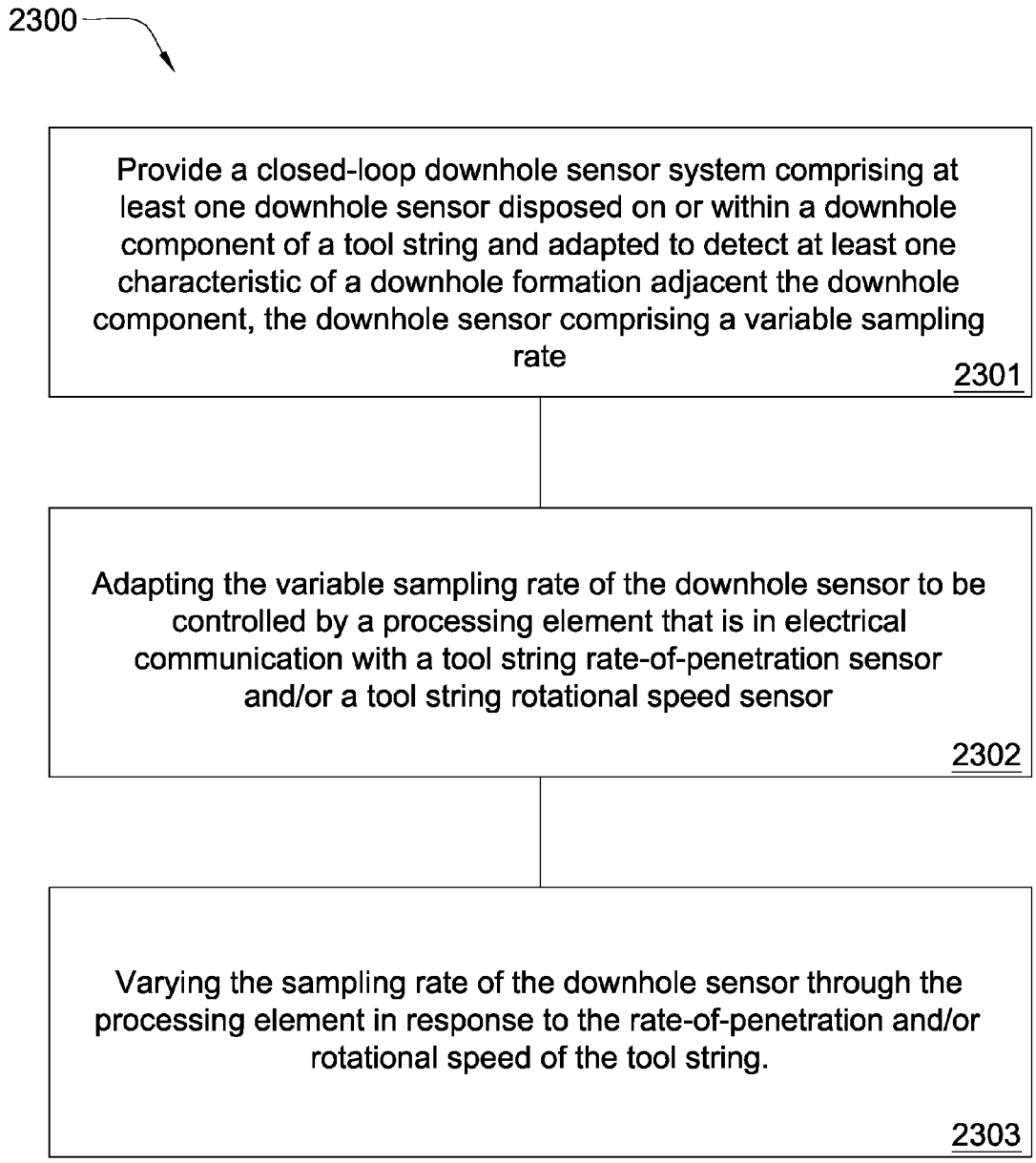
FIG. 23 is a flow-chart diagram of a method for logging-while-drilling.

FIG. 23 discloses a flow-chart of an embodiment of a method 2300 of logging-while-drilling comprising a step 2301 of providing a closed-loop downhole sensor system 400 comprising at least one downhole sensor 107 disposed on or within a downhole component 36 of a tool string 31. The downhole sensor 107 is adapted to detect at least one characteristic of a downhole formation 315 adjacent the downhole component 36 and the sensor 107 comprises a variable sampling rate. The method 2300 further comprises a step 2302 of adapting the variable sampling rate of the downhole sensor 107 to be controlled by a processing element 305 that is in electrical communication with a tool string rate-of-penetration sensor 401 and/or a tool string rotational speed sensor 402. The method 2300 further comprises a step 2303 of varying the sampling rate of the downhole sensor 107 by means of the processing element 305 in response to the rate-of-penetration and/or rotational speed of the tool string 31.

Whereas the present invention has been described in particular relation to the drawings attached hereto, it should be understood that other and further modifications apart from those shown or suggested herein, may be made within the scope and spirit of the present invention.

What is claimed is:

1. A downhole sensor system, comprising:

a plurality of downhole sensors disposed on or within a downhole component of a tool string and, at least one of the plurality of sensors adapted to detect a characteristic of a downhole formation adjacent the downhole component, the plurality of downhole sensors having a variable first sampling rate controlled by a processing element, and the processing element being in electrical communication with at least one of a tool string rate-of-penetration sensor and a tool string rotational speed sensor;

a switchbox configured to connect at least two of the plurality of downhole sensors in series and in parallel;

wherein the processing element is adapted to cause the switchbox to change a connection status of the at least two downhole sensors from one of parallel to series and series to parallel in response to at least one of the rate-of-penetration and the rotational speed of the tool string.

2. The downhole sensor system of claim 1, wherein the plurality of downhole sensors is mounted in at least one radial recess in an outer wall of the downhole component.

3. The downhole sensor system of claim 1, wherein the plurality of downhole sensors is adapted to sense at least one of natural gamma rays, acoustics, salinity, neutrons, a nuclear radiation, pressure, formation porosity, formation density, formation electrical conductivity, formation hardness, torque, weight-on-bit, and acceleration.

4. The downhole sensor system of claim 1, wherein the tool is incorporated into a drilling string, a tool string, a pushed coil tubing string, a wire line system, a cable system, and a geosteering system.

5. The downhole sensor system of claim 1, wherein the plurality of downhole sensors communicates with the processing element over a downhole network integrated into the downhole tool string.

6. The sensor system of claim 1, wherein the plurality of sensors are disposed discretely along an outer surface of the downhole component.

7. The downhole sensor system of claim 1, further comprising:

an extendable pad, the extendable pad including at least one of the plurality of downhole sensors; and, an arm assembly coupled to an outer surface of the downhole component, the arm assembly configured to extend the extendable pad towards the downhole formation.

8. The downhole sensor system of claim 1, wherein the system is a closed-loop system.

9. The downhole sensor system of claim 1, wherein the processing element is adapted to activate at least one of the plurality of sensors to sample in a selected axial direction.

10. The downhole sensor system of claim 1, wherein the rate of sampling decreases as at least one of the rate-of-penetration and the rotational speed decreases.

11. A downhole sensor system, comprising:

a tool string, the tool string including a plurality of downhole sensors in which at least a first downhole sensor is adapted to detect a selected characteristic at a variable sampling rate;

a switchbox capable of connecting at least two adjacent downhole sensors of the plurality of downhole sensors in series and in parallel;

at least one of a rate-of-penetration sensor capable of measuring the rate-of-penetration of the tool string and a rotational speed sensor capable of measuring the rotational speed of the tool string; and, a processing element in communication with the first downhole sensor and at least one of the rate-of-penetration sensor and the rotational speed sensor, the processing element adapted to vary the sampling rate of the first downhole sensor in response to at least one of the selected characteristic detected by the downhole sensor, the rate-of-penetration, and the rotational speed.

12. The downhole sensor system of claim 11, wherein said selected characteristic is a characteristic of a formation proximate to the first downhole sensor.

13. The downhole sensor system of claim 11, wherein the processing element communicates with the downhole sensor through at least one of an electrical connection, an inductive connection, an acoustic connection, a pressure connection, and an electromagnetic connection.

14. A method of logging, comprising:

positioning a tool string in a well, wherein the tool string includes a plurality of downhole sensors and a switchbox capable of selectively connecting at least two adjacent downhole sensors of the plurality of downhole sensors in series and in parallel;

detecting a selected characteristic at a sampling rate with at least a first downhole sensor of the plurality of downhole sensors;

measuring at least one of a rate-of-penetration and a rotational speed of the tool string;

communicating at least one of the selected characteristic, the rate-of-penetration and the rotational speed to a processing element;

changing a connection status of at least two adjacent downhole sensors from one of parallel to series and series to parallel in response to at least one of the selected characteristic, the rate-of-penetration and the rotational speed in accordance to instructions received by at least the first downhole sensor of the plurality of downhole sensors from the processing element.

15. The method of claim 14, wherein the selected characteristic is a characteristic of a formation proximate at the plurality of downhole sensors.

16. The method of claim 14, wherein communicating further comprises communicating through at least one of an electrical connection, an inductive connection, an acoustic connection, a pressure connection, and an electromagnetic connection.

17. The method of claim 14, further comprising conserving at least one of memory and energy of at least the first downhole sensor of said plurality of downhole sensors.

* * * * *